US007159639B2

(12) United States Patent
Tsuzuki et al.

(10) Patent No.: US 7,159,639 B2
(45) Date of Patent: Jan. 9, 2007

(54) DIECASTING MACHINE

(75) Inventors: Naohiko Tsuzuki, Akashi (JP); Hideaki Harada, Kariya (JP); Hiromi Takagi, Kariya (JP); Hitoshi Oosawa, Kariya (JP)

(73) Assignees: Toyo Machinery & Metal Co., Ltd., Hyogo (JP); Denso Corporation, Aichi (JP)

( * ) Notice: Subject to any disclaimer, the term of this patent is extended or adjusted under 35 U.S.C. 154(b) by 65 days.

(21) Appl. No.: 10/712,930

(22) Filed: Nov. 13, 2003

(65) Prior Publication Data

US 2004/0099401 A1 May 27, 2004

(30) Foreign Application Priority Data

Nov. 22, 2002 (JP) ..... 2002-339879

(51) Int. Cl.
*B22D 17/10* (2006.01)
*B22D 17/32* (2006.01)
*B22D 33/04* (2006.01)

(52) U.S. Cl. ..... 164/312; 164/341

(58) Field of Classification Search ..... 164/312, 164/314, 315, 113, 151, 155.1, 155.3, 155.4, 164/154.2, 154.8, 342, 341
See application file for complete search history.

(56) References Cited

U.S. PATENT DOCUMENTS 4,044,653 A * 8/1977 Aoki ..... 91/392
4,380,427 A * 4/1983 Hehl ..... 425/590
4,861,259 A 8/1989 Takada ..... 425/451.2
6,502,620 B1 * 1/2003 Jacobsen et al. ..... 164/18

FOREIGN PATENT DOCUMENTS

| | | |
|---|---|---|
| JP | 56-159136 | 12/1981 |
| JP | 61-188122 | 8/1986 |
| JP | 08-252847 | 10/1996 |
| JP | 10-202354 | * 8/1998 |
| JP | 2000-033472 | 2/2000 |
| JP | 2001-047299 | 1/2001 |

* cited by examiner

*Primary Examiner*—Kevin P. Kerns
(74) *Attorney, Agent, or Firm*—Jordan and Hamburg LLP

(57) ABSTRACT

A direct-acting type diecasting machine having an inexpensive and simplified hydraulic circuit is provided, which includes: a mold clamping cylinder for clamping and opening/closing a mold in a direct-acting manner; a single two-way hydraulic pump driven by a driving motor for supplying hydraulic fluid to the mold clamping cylinder in two directions; a hydraulic circuit for driving the mold clamping cylinder by controlling supply of hydraulic fluid from the two-way hydraulic pump to the mold clamping cylinder and discharge of hydraulic fluid from the mold clamping cylinder which proceeds in accordance with movement of a piston of the mold clamping cylinder; and a hydraulic controller for controlling rotational speed of the driving motor associated with the two-way hydraulic pump in opening/closing the mold at high speed and controlling torque of the driving motor in clamping the mold.

6 Claims, 3 Drawing Sheets

PRIOR ART

DIECASTING MACHINE

BACKGROUND OF THE INVENTION

1. Field of the Invention

The present invention relates to a diecasting machine utilizing a hybrid hydraulic circuit.

2. Description of the Related Art

A diecasting machine is an apparatus in which a piston of an injection cylinder is actuated by hydraulic pressure to inject and load molten metal fed to a molten metal loading sleeve into a clamped mold at high speed and, after pressure maintaining/cooling is performed at high pressure, the mold is opened to remove the diecast product. For the operation cycle to be shortened, the opening and closing of the mold need be performed at high speed. On the other hand, in mold clamping which applies high pressure to the mold, a movable mold member need be moved toward a stationary mold member at low speed for avoiding damage to the mold, and when the mold members substantially fit each other, high pressure is applied to clamp the mold.

For this reason, a prior-art diecasting machine B employs a toggle mechanism G as a mold clamping device, as shown in FIG. 3. However, such a toggle mechanism G is mechanically complicated and often suffers from mechanical troubles. Further, since the prior-art diecasting machine has a high parts count, the machine has a disadvantage in terms of cost. Although a clamping device of the direct-acting type is also available, an expensive booster cylinder need be used to realize the above-described operation, which also results in an increased cost, as known from U.S. Pat. No. 4,861,259.

SUMMARY OF THE INVENTION

The present invention has been conceived in view of the foregoing prior-art problems. Accordingly, it is an object of the present invention is to realize an inexpensive direct-acting mold clamping device with a simple hydraulic circuit.

In accordance with a first aspect of the present invention, there is provided a diecasting machine comprising:

a mold clamping cylinder for clamping and opening/closing a mold in a direct-acting manner;

a single two-way hydraulic pump driven by a driving motor for supplying hydraulic fluid to the mold clamping cylinder in two directions;

a hydraulic circuit for driving the mold clamping cylinder by controlling supply of hydraulic fluid from the two-way hydraulic pump to the mold clamping cylinder and discharge of hydraulic fluid from the mold clamping cylinder which proceeds in accordance with movement of a piston of the mold clamping cylinder; and a hydraulic controller for controlling rotational speed of the driving motor associated with the two-way hydraulic pump in opening/closing the mold at high speed and controlling torque of the driving motor in clamping the mold.

In the diecasting machine of this construction using the single two-way hydraulic pump, the rotational speed of the driving motor associated with the two-way hydraulic pump is controlled in the high-speed mold opening/closing operation, while the torque of the driving motor is controlled in the mold clamping operation. Therefore, unlike the prior-art diecasting machine, the diecasting machine of the present invention does not need an expensive booster cylinder.

In accordance with another aspect of the present invention, there is provided a diecasting machine comprising:

a mold clamping cylinder for clamping and opening/closing a mold in a direct-acting manner;

a plurality of two-way hydraulic pumps connected in parallel with each other and driven by a driving motor for supplying hydraulic fluid to the mold clamping cylinder in two directions;

a hydraulic circuit for driving the mold clamping cylinder by controlling supply of hydraulic fluid from the two-way hydraulic pumps to the mold clamping cylinder and discharge of hydraulic fluid from the mold clamping cylinder which proceeds in accordance with movement of a piston of the mold clamping cylinder; and a hydraulic controller for actuating one of the two-way hydraulic pumps which is larger in capacity or both of the two-way hydraulic pumps in opening/closing the mold at high speed and actuating any one of the two-way hydraulic pumps or one of the two-way hydraulic pumps which is smaller in capacity in clamping the mold.

In the diecasting machine of this construction, the two-way hydraulic pump having a larger capacity or both of the two-way hydraulic pumps are actuated to supply a large amount of hydraulic fluid to the mold clamping cylinder in opening/closing the mold, thereby realizing mold opening/closing at high speed. On the other hand, in the mold clamping operation which requires little hydraulic fluid supply but calls for high pressure, either one of the two-way hydraulic pumps or the two-way hydraulic pump having a smaller capacity is actuated under torque control to supply only a required amount of hydraulic fluid as the need arises. Such a construction makes it possible to considerably simplify the hydraulic piping and reduce the energy loss.

In one embodiment, the two two-way hydraulic pumps are generally equal in capacity.

In another embodiment, one of the two-way hydraulic pumps which is driven in opening/closing the mold at high speed is larger in capacity than the other two-way hydraulic pump which is not driven in opening/closing the mold at high speed.

With the former embodiment, if a maximum discharge rate is necessary, both of the hydraulic pumps are actuated to deliver hydraulic fluid. Accordingly, the capacity of each hydraulic pump can be made smaller than in the case where a single two-way hydraulic pump is used. Thus, this embodiment is economical in that respect With the latter embodiment, one of the two-way hydraulic pumps which is smaller in capacity can be used in clamping the mold and, hence, the power consumption in clamping the mold can be reduced. Thus, this embodiment is economical in that respect In yet another embodiment, the hydraulic controller is operative to control a discharge rate of the two-way hydraulic pump or pumps based on hydraulic pressure information from a hydraulic fluid pipeline situated on a side toward which the piston is protruding.

This embodiment is capable of more precise torque control in clamping the mold.

Preferably, the driving motor associated with the two-way hydraulic pump or with each of the two-way hydraulic pumps driving motor is a servomotor.

The use of such a servomotor as the driving motor makes it possible to feedback-control the rotational speed and the torque freely and accurately, so that the injecting step, dwelling step and cooling step can be controlled highly accurately.

The foregoing and other objects, features and attendant advantages of the present invention will become apparent from the reading of the following detailed description in conjunction with the accompanying drawings.

DETAILED DESCRIPTION OF THE PREFERRED EMBODIMENTS

The present invention will now be described in detail by way of preferred embodiments thereof with reference to the accompanying drawings.

Figure 1:
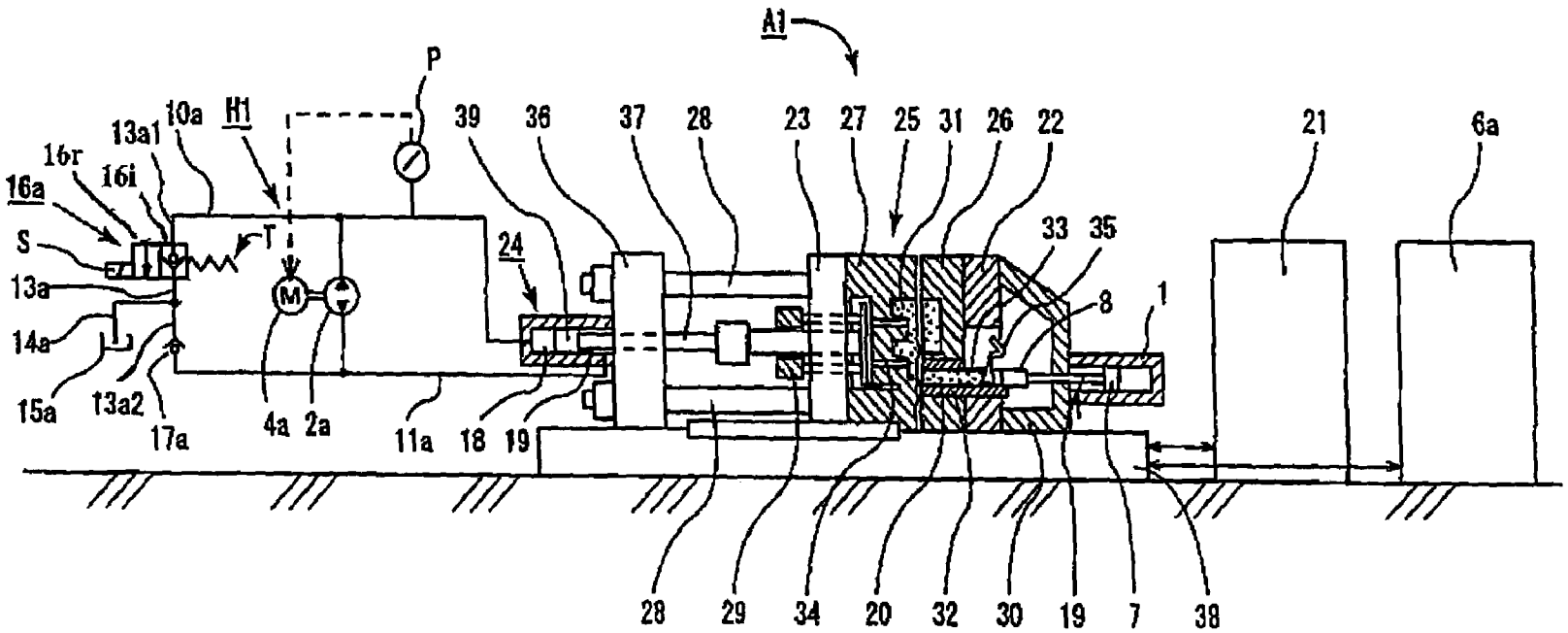
FIG. 1 is a partially sectional view illustrating a diecasting machine according to a first embodiment of the present invention.

Referring first to FIG. 1, a diecasting machine A1 with a single two-way hydraulic pump 2*a* according to a first embodiment generally comprises a stationary platen 22 mounted on a machine base 38, a movable platen 23 disposed in facing relation to the stationary platen 22, a mount platen 36 to which a mold clamping cylinder 24 is mounted, a stationary mold member 26 and a movable mold member 27 respectively mounted to the stationary platen 22 and the movable platen 23, a tie bar 28 bridging between the stationary platen 22 and the mount platen 36 for guiding the sliding movement of the movable platen 23, an eject mechanism 29 for ejecting a diecast product out of the movable mold member 27 when the mold is opened, the above-described mold clamping cylinder 24, a frame 30 fitted on the stationary platen 22, a mold sleeve 32 mounted to the stationary platen 22 for loading molten metal 20 into a mold cavity 31, an injection cylinder 1 fitted in the frame 30, a hybrid hydraulic circuit H1 including the two-way hydraulic pump 2*a*, a driving motor 4*a* such as a servo motor for driving the two-way hydraulic pump 2*a* and the like, a hydraulic controller 6*a* for controlling the hybrid hydraulic circuit H1, and a machine controller 21.

The mold sleeve 32 is a cylindrical member having a molten metal supply port 33 located in the stationary platen 22. The mold sleeve 32 is provided with a molten metal supply unit 35 for supplying molten metal 20 to the molten metal supply port 33. The injection cylinder 1 includes a piston 7 having a tip end provided with a plunger 8. The plunger 8 slides within the mold sleeve 32 to inject the molten metal 20 fed to the mold sleeve 32 into the mold cavity 31 of the mold 25 at high speed.

The mold 25, which consists of the stationary mold member 26 and the movable mold member 27, defines therein the mold cavity 31 having a predetermined configuration and communicating with the mold sleeve 32.

The mold clamping cylinder 24 includes a cylinder rod 37 fixed to the movable platen 23, so that the movable platen slides along the tie bar 28 in accordance with the operation of the mold clamping cylinder 24 to clamp and open/close the mold. The eject mechanism 29, which is mounted to the movable platen 23, includes eject pins 34 extending through the movable platen 23 to protrude into and retract from the mold cavity 31.

Next, the hybrid hydraulic circuit H1 for actuating the mold clamping cylinder 24 will be described. The mold clamping cylinder 24 defines therein a piston-protruding-side hydraulic fluid chamber 18 connected to a piston-protruding-side hydraulic fluid pipeline 10*a* for fluid communication and a piston-retracting-side hydraulic fluid chamber 19 connected to a piston-retracting-side hydraulic fluid pipeline 11*a* for fluid communication. The two-way hydraulic pump 2*a* interconnects the piston-protruding-side hydraulic fluid pipeline 10*a* and piston-retracting-side hydraulic fluid pipeline 11*a* for fluid communication.

The two-way hydraulic pump 2*a* is connected to the driving motor 4*a* which is servo controlled so that hydraulic fluid of an optimum amount or pressure is supplied to the mold clamping cylinder 24 in accordance with the sequence, whereby highly precise mold opening/closing at high speed and mold clamping at high torque can be realized. It is to be noted that the two-way hydraulic pump 2*a* can discharge hydraulic fluid in two directions, i.e. toward the piston-protruding-side hydraulic fluid pipeline 10*a* and toward the piston-retracting-side hydraulic fluid pipeline 11*a*.

The piston-protruding-side hydraulic fluid pipeline 10*a* and the piston-retracting-side hydraulic fluid pipeline 11*a* are connected to each other via a common pipeline 13*a* for fluid communication. The common pipeline 13*a* is connected to a tank pipeline 14*a* for returning hydraulic fluid to a hydraulic fluid tank 15*a* when the amount of hydraulic fluid in the common pipeline 13*a* is excessive and for sucking hydraulic fluid from the hydraulic fluid tank 15*a* when the amount of hydraulic fluid in the common pipeline 13*a* is insufficient. The common pipeline 13*a* is provided with a check/one-way valve 16*a* at a portion 13*a*1 located adjacent the piston-protruding-side hydraulic fluid pipeline 10*a* and with a check valve 17*a* at a portion 13*a*2 located adjacent the piston-retracting-side hydraulic fluid pipeline 11*a* for preventing hydraulic fluid from returning toward the tank pipeline 14*a*.

The check/one-way valve 16*a* is provided with a solenoid S and a spring T, which act to switch the check/one-way valve 16*a* between a state which allows hydraulic fluid to be sucked from the hydraulic fluid tank 15*a* and fed to the piston-protruding-side hydraulic fluid chamber 18 (in which state hydraulic fluid does not flow reversely) and a state which allows hydraulic fluid discharged from the piston-protruding-side hydraulic fluid chamber 18 to be returned to the hydraulic fluid tank 15*a*.

Between the mold clamping cylinder 24 and the two-way hydraulic pump 2*a* is provided a pressure gauge P which constantly measures the pressure in the piston-protruding-side hydraulic fluid pipeline 10*a*. Based on the value of pressure thus measured, the driving motor 4*a* is servo-controlled by the controller 6*a*.

Next, description is directed to the operation of the first embodiment A1. A series of operations of the mold consists of a mold-closing operation for moving the movable mold member 27 to a position just before the stationary mold member 26 at high speed, a clamping operation, which follows the mold-closing operation, for pressing the movable mold member 27 against the stationary mold member 26 with a predetermined pressure to clamp the mold until injection of molten metal 20 into the mold cavity 31 and the subsequent dwelling and cooling are completed, and a mold-opening operation for removing the diecast product cooled and solidified.

Since no pressing force is exerted on the mold 25 during the mold-closing operation and the mold-opening operation, it is desirable that the movable mold member be moved at high speed in order to shorten the cycle. Therefore, the two-way hydraulic pump 2*a* is operated under rotational speed control in the mold-closing operation and the mold-opening operation which require a large amount of hydraulic fluid. In the clamping operation which requires not a large amount of hydraulic fluid but a high pressure, on the other hand, the two-way hydraulic pump 2*a* is operated under torque control. The operation of the first embodiment A1 will be specifically described step by step.

In the mold-closing operation for moving the movable mold member 27 from a mold-open position to a position just before the stationary mold member 26, the driving motor 4*a* is operated under rotational speed control to cause the two-way hydraulic pump 2*a* to discharge a large amount of hydraulic fluid to the piston-protruding-side hydraulic fluid pipeline 10*a*. Hydraulic fluid discharged from the two-way hydraulic pump 2*a* in the forward direction flows into the piston-protruding-side hydraulic fluid chamber 18 of the mold clamping cylinder 24, causing the piston 39 to protrude. At that time, hydraulic fluid partially flows toward the check/one-way valve 16*a* of the hydraulic fluid tank 15. However, since the solenoid S of the check/one-way valve 16*a* is not actuated at this stage, hydraulic fluid is stopped at a check valve position 16*i* of the check/one-way valve 16*a* so as not to flow into the hydraulic fluid tank 15*a*. As a result, the hydraulic fluid discharged from the two-way hydraulic pump 2*a* is wholly fed to the piston-protruding-side hydraulic fluid chamber 18.

In accordance with this operation, the piston 39 advances to push hydraulic fluid out of the piston-retracting-side hydraulic fluid chamber 19, and the hydraulic fluid thus discharged is wholly fed to the two-way hydraulic pump 2*a*. However, since the piston-protruding-side hydraulic fluid chamber 18 of the mold clamping cylinder 24 is larger in capacity than the piston-retracting-side hydraulic fluid chamber 19, the shortage is made up for by just a required amount of hydraulic fluid sucked from the hydraulic fluid tank 15*a* to the two-way hydraulic pump 2*a* through the check valve 17*a*.

As a result, a large amount of hydraulic fluid flows into the piston-protruding-side hydraulic fluid chamber 18, causing the piston 39 to protrude at high speed. Since the cylinder rod 37 connected to the piston 39 is fixed to the movable platen 23, the movable mold member 27 mounted to the movable platen 23 moves toward the stationary mold member 26 at high speed.

When the movable mold member comes to a position just short of contacting the stationary mold member 26, control over the driving motor 4*a* is switched from the rotational speed control to the torque control. The switching is made through detection of the position of the movable mold member 27. After switching, the process proceeds to the mold clamping operation at high pressure.

Meanwhile, the rotation of the driving motor 4*a* is servo-controlled so that the movable mold member 27 moves slowly to come into contact with the stationary mold member 26 without shock. When the movable mold member 27 comes into contact with the stationary mold member 26, the torque control is performed to continue pressurization for clamping the mold at a predetermined pressing force.

When the clamping is completed, the injection cylinder 1 is actuated to advance the piston 7 so that the plunger 8 attached to the tip end of the piston 7 advances. As a result, molten metal 20 in the mold sleeve 32 is loaded into the mold cavity 31 by injection.

When the injection/loading of molten metal is completed, the process proceeds to the dwelling/cooling step. In this step, a small amount of high-pressure hydraulic fluid is supplied to the injection cylinder 1 to maintain the high-pressure state, and a small amount of molten metal 20 is additionally supplied into the mold cavity 31 as the volume of the loaded molten metal decreases due to cooling.

When the molten metal loaded in the mold cavity 31 is solidified, the cooling step is finished. Subsequently, the piston 39 of the mold clamping cylinder 24 is returned to open the mold. In this case, the two-way hydraulic pump 2*a* is switched from the torque control back to the rotational speed control so that hydraulic fluid is supplied to the piston-retracting-side hydraulic fluid chamber 19 through the piston-retracting-side hydraulic fluid pipeline 11*a*. In reaction to thereto, the piston 39 moves in the returning direction while discharging hydraulic fluid to the piston-protruding-side hydraulic fluid pipeline 10*a*. At that time, the valve position of the check/one-way valve 16*a* has been switched into the one-way valve position 16*r* by the action of the solenoid S, so that most part of the hydraulic fluid discharged to the piston-protruding-side hydraulic fluid pipeline 10*a* is supplied to the two-way hydraulic pump 2*a*, while at the same time, the difference in fluid amount between the piston-retracting-side hydraulic fluid chamber 19 and the piston-protruding-side hydraulic fluid chamber 18 is returned to the hydraulic fluid tank 15*a* through the one-way valve position 16*r*.

Although part of the hydraulic fluid discharged from the two-way hydraulic pump 2*a* to the piston-retracting-side hydraulic fluid pipeline 11*a* flows toward the hydraulic fluid tank 15*a*, the check valve 17*a* blocks this flow and prevents this part of the hydraulic fluid from flowing into the hydraulic fluid tank 15*a*. In this way, diecasting is performed using the sole two-way hydraulic pump 2*a*.

In the mold-opening operation, the solidified diecast product adhering to the movable mold member 27 is moved along with the movable mold member 27. Finally, the eject mechanism 29 is actuated to cause the eject pin 34 to protrude so that the solidified diecast product is released from the movable mold member 27 for collection.

Figure 2:
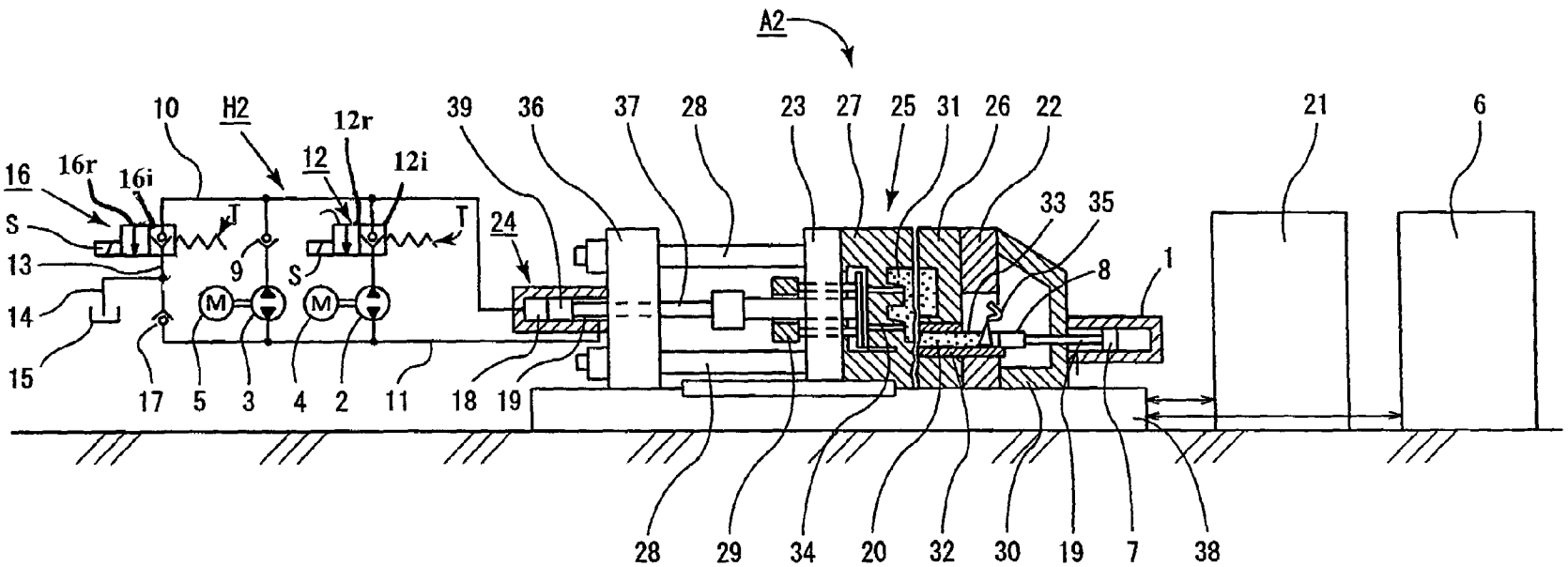
FIG. 2 is a partially sectional view illustrating a diecasting machine according to a second embodiment of the present invention.
Figure 3:
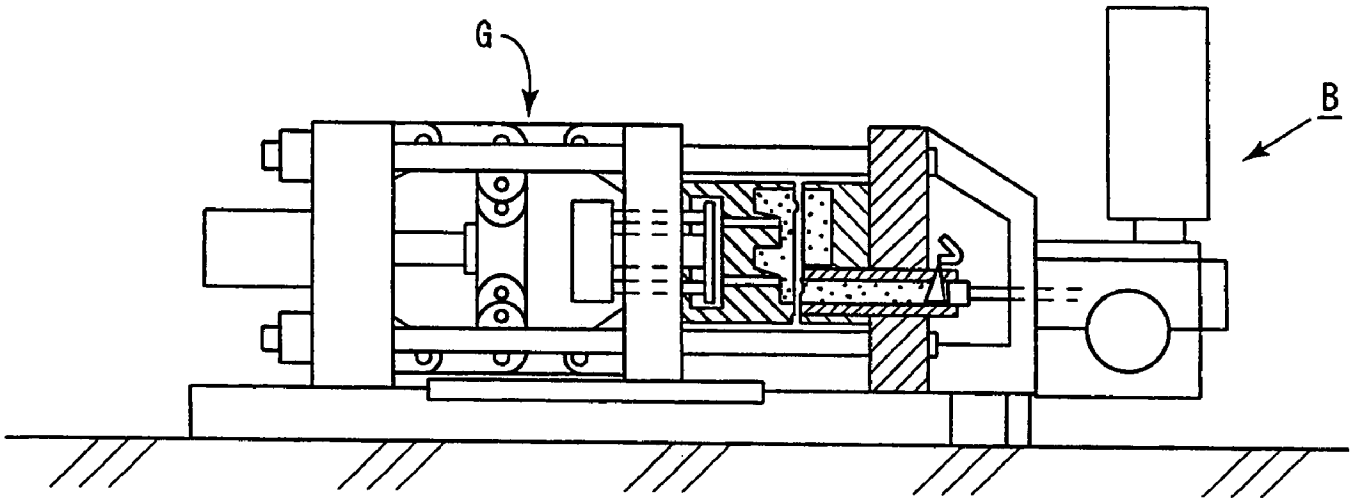
FIG. 3 is a partially sectional view illustrating a prior art diecasting machine.

With reference to FIG. 2, description will be made of a second embodiment A2 employing two two-way hydraulic pumps 2 and 3. For easy description, features which are different from those of the first embodiment will be described mainly.

The construction of the second embodiment A2 is generally identical to that of the first embodiment A1 but slightly differs in the structure of the hybrid hydraulic circuit H2 because of the use of two two-way hydraulic pumps. The two two-way hydraulic pumps to be used have their respective capacities which may be equal to or different from each other. Description is first directed to the case where the pumps have different capacities.

In the hybrid hydraulic circuit H2 of the second embodiment A2, a mold clamping cylinder 24 defines therein a piston-protruding-side hydraulic fluid chamber 18 connected to a piston-protruding-side hydraulic fluid pipeline 10 for fluid communication, and a piston-retracting-side hydraulic fluid chamber 19 connected to a piston-retracting-side hydraulic fluid pipeline 11 for fluid communication. Between the piston-protruding-side hydraulic fluid pipeline 10 and the piston-retracting-side hydraulic fluid pipeline 11 are provided a larger-capacity two-way hydraulic pump 2 and a smaller-capacity two-way hydraulic pump 3, which are connected in parallel. In this embodiment, the larger-capacity two-way hydraulic pump 2 for high-speed injection is disposed on the side closer to the mold clamping cylinder 24, whereas the smaller-capacity two-way hydraulic pump 3 disposed on the side away from the mold clamping cylinder 24. Between the larger-capacity two-way hydraulic pump 2 and the piston-protruding-side hydraulic fluid pipeline 10 is disposed a check/one-way valve 12.

The check/one-way valve 12 (as well as the check/one-way valve 16 which will be described later) assumes a check valve position 12*i* (16*i* in the case of the check/one-way valve 16) when the solenoid S is not actuated with the spring T is acting. In this state, hydraulic fluid flowing in the forward direction (i.e. from the larger-capacity two-way hydraulic pump 2 toward the piston-protruding-side hydraulic fluid pipeline 10 or from hydraulic fluid tank 15 toward the piston-protruding-side hydraulic fluid pipeline 10 in this case) is allowed to pass through the check/one-way valve 12, but hydraulic fluid flowing in the reverse direction (i.e. from the piston-protruding-side hydraulic fluid pipeline 10 toward the large-capacity two-way hydraulic pump 2 or from the piston-protruding-side hydraulic fluid pipeline 10 toward the hydraulic fluid tank 15) is prevented from passing through the check/one-way valve 12. When the solenoid S is actuated to switch the valve 12 into a one-way valve position 12*r* (16*r* in the case of the check/one-way valve 16), hydraulic fluid flowing from the side opposite to the check valve position 12*i* (or 16*i*) (i.e. from the piston-protruding-side hydraulic fluid pipeline 10 toward the large-capacity two-way hydraulic pump 2 or toward the hydraulic fluid tank 15) is allowed to pass through the check/one-way valve 12.

Between the smaller-capacity two-way hydraulic pump 3 and the piston-protruding-side hydraulic fluid pipeline 10 is provided a check valve 9 which allows forward flow of hydraulic fluid from the smaller-capacity two-way hydraulic pump 3 but blocks reverse flow of the hydraulic fluid.

The two-way hydraulic pumps 2 and 3 are respectively connected to the driving motors 4 and 5 which are servo-controlled so that hydraulic fluid of an optimum amount or pressure is supplied to the mold clamping cylinder 24 in accordance with the sequence, whereby highly precise mold opening/closing at high speed (under rotational speed control) and mold clamping (under torque control) can be realized. It is to be noted that the two-way hydraulic pumps 2 and 3 can discharge hydraulic fluid in two directions, i.e. toward the direction of the piston-protruding-side hydraulic fluid pipeline 10 and toward the piston-retracting-side hydraulic fluid pipeline 11, similarly as in the first embodiment.

The piston-protruding-side hydraulic fluid pipeline 10 and the piston-retracting-side hydraulic fluid pipeline 11 are connected to each other via a common pipeline 13 for fluid communication. The common pipeline 13 is connected to a tank pipeline 14 for returning hydraulic fluid to the hydraulic fluid tank 15 when the amount of hydraulic fluid in the common pipeline 13 is excessive and for sucking hydraulic fluid from the hydraulic fluid tank 15 when the amount of hydraulic fluid in the common pipeline 13 is insufficient. The common pipeline 13 is provided with a check/one-way valve 16 at a portion 13*a*1 located adjacent the piston-protruding-side hydraulic fluid pipeline 10 and between the tank pipeline 14 and the piston-protruding-side hydraulic fluid pipeline 10 and with a check valve 17 at a portion 13*a*2 located adjacent the piston-retracting-side hydraulic fluid pipeline 11 for preventing hydraulic fluid from returning toward the tank pipeline 14.

Similarly to the first embodiment, between the mold clamping cylinder 24 and the larger-capacity two-way hydraulic pump 2 is provided a pressure gauge P which constantly measures the pressure in the piston-protruding-side hydraulic fluid pipeline 10. Based on the value of pressure thus measured, the controller 6 servo-controls the switching between the driving motors 4 and 5, rotational speed control and torque control.

The operation of the second embodiment A2 is as follows. Firstly, the mold clamping cylinder 24 is actuated to move the movable platen 23 mounting the movable mold member 27 from the mold-open position at high speed to close the mold. At that time, the driving motor 4 is actuated under rotational speed control to cause the larger-capacity two-way hydraulic pump 2 to perform a high discharge rate operation because a large amount of hydraulic fluid need be discharged. The large amount of hydraulic fluid discharged from the larger-capacity two-way hydraulic pump 2 in the forward direction flows through the check valve position 12*i* into the piston-protruding-side hydraulic fluid chamber 18 of the mold clamping cylinder 24 to cause the piston 39 to protrude. At that time, part of the hydraulic fluid flows toward the check/one-way valve 16 on the hydraulic fluid tank 15 side. However, since the solenoid S of the check/one-way valve 16 is not actuated at this stage, the hydraulic fluid is stopped at the check valve position 16*i* of the check/one-way valve 16 so as not to flow into the hydraulic fluid tank 15. Similarly, although part of the hydraulic fluid flows in the reverse direction toward the smaller-capacity two-way hydraulic pump 3, the check valve 9 blocks the hydraulic fluid so as not to flow into smaller-capacity two-way hydraulic pump 3. As a result, the hydraulic fluid is wholly supplied to the piston-protruding-side hydraulic fluid chamber 18.

In accordance with this operation, the piston 39 advances to push hydraulic fluid out of the piston-retracting-side hydraulic fluid chamber 19, and the hydraulic fluid thus pushed out is wholly supplied to the larger-capacity two-way hydraulic pump 2. As in the first embodiment, the piston-protruding-side hydraulic fluid chamber 18 of the mold clamping cylinder 24 is larger in capacity than the piston-retracting-side hydraulic fluid chamber 19. Therefore, the shortage is made up for by just a required amount of hydraulic fluid sucked from the hydraulic fluid tank 15 through the check valve 17 for supply to the larger-amount two-way hydraulic pump 2.

As a result, similarly as in the first embodiment A1, a large amount of hydraulic fluid flows into the piston-protruding-side hydraulic fluid chamber 18, causing the piston 39 to protrude at high speed. Since the cylinder rod 37 attached to the tip end of the piston 39 is fixed to the movable platen 23, the movable mold member 27 mounted to the movable platen 23 moves toward the stationary mold member 26 at high speed.

When the movable mold member 27 comes to a position just short of contacting the stationary mold member 26, the driving motor 4 is stopped to stop the supply of hydraulic fluid from the larger-capacity two-way hydraulic pump 2. Then, the driving motor 5 is operated under torque control to cause the smaller-capacity two-way hydraulic pump 3 to discharge hydraulic fluid for clamping the mold by a predetermined clamping force. The switching from the driving motor 4 to the driving motor 5 is achieved through detection of the position of the movable mold member 27. When the switching is completed, the process proceeds to the mold clamping operation at high pressure, as described before.

Meanwhile, the rotation of the driving motor 4 is servo-controlled so that the movable mold member 27 moves slowly to come into contact with the stationary mold member 26 without shock. When the movable mold member 27 comes into contact with the stationary mold member 26, torque control is performed to continue pressurization for clamping the mold at a predetermined pressing force. The manner of hydraulic fluid supply/discharge in relation to the smaller-capacity two-way hydraulic pump 3 is the same as that of hydraulic fluid supply/discharge in relation to the larger-capacity two-way hydraulic pump 2.

When the clamping is completed, the injection cylinder 1 is actuated to advance the piston 7 so that the plunger 8 attached to the tip end of the piston 7 advances. As a result, molten metal 20 in the mold sleeve 32 is loaded into the mold cavity 31 by injection.

When the loading of molten metal is completed, the process proceeds to the dwelling/cooling step. In this step, a small amount of high-pressure hydraulic fluid is supplied to the injection cylinder 1 to maintain the high-pressure state, while a small amount of molten metal 20 is supplied into the mold cavity 31 as the volume of the loaded molten metal decreases due to cooling.

When the molten metal loaded in the mold cavity 31 is solidified, the cooling step is finished. Subsequently, the piston 39 of the mold clamping cylinder 24 is returned to open the mold. In that case, the mold clamping operation by the smaller-capacity two-way hydraulic pump 3 shifts to the high-speed mold opening operation by the larger-capacity two-way hydraulic pump 2 in which a large amount of hydraulic fluid is discharged from the larger-capacity two-way hydraulic pump 2 and supplied to the piston-retracting-side hydraulic fluid chamber 19 through the piston-retracting-side hydraulic fluid pipeline 11. In reaction thereto, the piston 39 moves in the returning direction so that hydraulic fluid is discharged from the piston-protruding-side hydraulic fluid chamber 18 to the piston-protruding-side hydraulic fluid pipeline 10. At that time, by the actions of the solenoids S, the positions of the check/one-way valves 12 and 16 have been switched into their respective one-way valve positions 12*r* and 16*r*. Therefore, most part of the hydraulic fluid discharged to the piston-protruding-side hydraulic fluid pipeline 10 is supplied to the two-way hydraulic pump 2*a* through the one-way valve position 12*r*, while at the same time, the difference in fluid amount between the piston-retracting-side hydraulic fluid chamber 19 and the piston-protruding-side hydraulic fluid chamber 18 is returned to the hydraulic fluid tank 15 through the one-way valve position 16*r*.

Although part of the hydraulic fluid discharged from the larger-capacity two-way hydraulic pump 2 to the piston-retracting-side hydraulic fluid pipeline 11 flows toward the hydraulic fluid tank 15, the check valve 17 blocks this flow and prevents this part of the hydraulic fluid from flowing into the hydraulic fluid tank 15. In this way, diecasting is performed using two two-way hydraulic pumps 2 and 3.

In the mold opening operation, the solidified diecast product adhering to the movable mold member 27 moves together with the movable mold member 27. Finally, the eject mechanism 29 is actuated to cause the eject pin 34 to protrude so that the solidified diecast product is released from the movable mold member 27 for collection.

In the above-described high-speed mold opening operation, both of the driving motors 4 and 5 may be actuated to actuate the larger-capacity two-way hydraulic pump 2 and the smaller-capacity two-way hydraulic pump 3 so that a much larger amount of hydraulic fluid is discharged from the larger-capacity two-way hydraulic pump 2 and the smaller-capacity two-way hydraulic pump 3. In this case, the maximum discharge rate is the sum of the discharge rate of the larger-capacity two-way hydraulic pump 2 and that of the smaller-capacity two-way hydraulic pump 3. Therefore, the capacity of the larger-capacity two-way hydraulic pump 2 can be reduced by a value as large as the capacity of the smaller-capacity two-way hydraulic pump 3. In this case, the two-way hydraulic pumps 2 and 3 may have equal capacity. In clamping the mold, the smaller-capacity two-way hydraulic pump 3 is used.

As has been described above, the diecasting machine using a single two-way hydraulic pump according to the present invention is constructed such that the rotational speed of the driving motor associated with the two-way hydraulic pump is controlled in the high-speed mold opening/closing operation, whereas the torque of the driving motor is controlled in the mold clamping operation. Therefore, unlike the prior art, the diecasting machine does not need an accumulator or an expensive booster cylinder. Therefore, the diecasting machine can have piping of a very simplified structure, save hydraulic fluid to be used, and enhance the injection accuracy.

The diecasting machine using a plurality of (two) two-way hydraulic pumps according to the present invention is capable of actuating both of the hydraulic pumps simultaneously under rotational speed control to discharge a large amount of hydraulic fluid or actuating only the larger-capacity hydraulic pump to supply a required amount of hydraulic fluid in the high-speed mold opening/closing operation. In the mold clamping operation, either one of the two-way hydraulic pumps or the smaller-capacity two-way hydraulic pumps is operated under torque control to continue the required clamping. Also in this case, such an accumulator or an expensive booster cylinder as required in the prior art is unnecessary. Therefore, the diecasting machine can have piping of a very simplified structure, save hydraulic fluid to be used, and enhance the injection accuracy. Further, since the two-way hydraulic pump used in the mold clamping operation has a smaller capacity than the other, the diecasting machine can save energy accordingly and realize considerable energy loss reduction.

Moreover, the use of a servomotor as the driving motor for each two-way hydraulic pump makes it possible to feedback-control the rotational speed and the torque freely and accurately, so that the injecting step, dwelling step and cooling step can be controlled highly accurately.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A diecasting machine comprising:

a mold clamping cylinder for clamping and opening/closing a mold in a direct-acting manner;

a single two-way hydraulic pump driven by a servo driving motor for supplying hydraulic fluid to the mold clamping cylinder in two directions;

a hydraulic circuit for driving the mold clamping cylinder by controlling supply of hydraulic fluid from the two-way hydraulic pump to the mold clamping cylinder and discharge of hydraulic fluid from the mold clamping cylinder which proceeds in accordance with movement of a piston of the mold clamping cylinder; and a hydraulic controller for controlling rotational speed of the servo driving motor associated with the two-way hydraulic pump in opening/closing the mold at high speed and controlling torque of the servo driving motor in clamping the mold;

wherein, said piston-protruding-side hydraulic fluid pipeline being connected to a piston-protruding-side hydraulic fluid chamber of a mold clamping cylinder;

a piston-retracting-side hydraulic fluid pipeline being connected to a piston-retracting-side hydraulic fluid chamber;

said two-way hydraulic pump being connected in between said piston-protruding-side hydraulic fluid pipeline and said piston-retracting-side hydraulic fluid pipeline;

said piston-protruding-side hydraulic fluid pipeline and piston-retracting-side hydraulic fluid pipeline are connected by a common pipeline;

a tank pipeline disposed in said common pipeline for causing hydraulic pressure to return to a hydraulic fluid tank and for causing hydraulic fluid to be suctioned from said hydraulic fluid tank;

a check/one-way valve disposed on a piston-protruding-side hydraulic fluid pipeline side section of said common pipeline; and a check valve disposed on said piston-refracting-side hydraulic fluid pipeline side section of said common pipeline, said check valve inhibiting hydraulic fluid from returning in a direction of said tank pipeline.

2. The diecasting machine according to claim 1, wherein the hydraulic controller is operative to control a discharge rate of the two-way hydraulic pump based on hydraulic pressure information from a hydraulic fluid pipeline situated on a side toward which the piston is protruding.

3. A diecasting machine comprising:

a mold clamping cylinder including a piston for clamping and opening/closing a mold in a direct-acting manner;

a plurality of two-way hydraulic pumps, including first and second pumps, connected in parallel with each other and driven by respective servo driving motors for supplying hydraulic fluid to the mold clamping cylinder in two directions;

said first and second pumps each having a first port, each first port connecting to a piston-protruding-side port and not to a retraction port;

said first and second pumps each having a second port, each second port connecting to said retraction port of said cylinder and not to said piston-protruding-side port;

a hydraulic circuit for driving the mold clamping cylinder by controlling supply of hydraulic fluid from the two-way hydraulic pumps to the mold clamping cylinder and discharge of hydraulic fluid from the mold clamping cylinder for advancing or retracting said piston;

said hydraulic circuit comprising a plurality of valves, said valves consisting of a check valve and a check/one way valve; and a hydraulic controller for:

actuating, during opening/closing of the mold at high speed, both of said two-way hydraulic pumps or one of said two-way hydraulic pumps which is larger in capacity; and actuating, during clamping, either of the two-way hydraulic pumps or one of the two-way hydraulic pumps which is smaller in capacity.

4. The diecasting machine according to claim 3, wherein the two two-way hydraulic pumps are generally equal in capacity.

5. The diecasting machine according to claim 3, wherein one of the two-way hydraulic pumps which is driven in opening/closing the mold at high speed is larger in capacity than the other two-way hydraulic pump which is not driven in opening/closing the mold at high speed.

6. The diecasting machine according to claim 3, wherein the hydraulic controller is operative to control a discharge rate of each of the two-way hydraulic pumps based on hydraulic pressure information from a hydraulic fluid pipeline situated no a side toward which the piston is protruding.

* * * * *